US005739738A

United States Patent [19]

Hansen et al.

[11] Patent Number: 5,739,738

[45] Date of Patent: Apr. 14, 1998

[54] INFLATABLE HI Q TOROIDAL INDUCTOR

[75] Inventors: Peder M. Hansen; Eldred M. Smith, both of San Diego, Calif.

[73] Assignee: The United States of America as represented by the Secretary of the Navy, Washington, D.C.

[21] Appl. No.: 278,665

[22] Filed: Jul. 18, 1994

[51] Int. Cl.[6] ..... H01F 21/02; H01F 27/30; H01F 27/28

[52] U.S. Cl. ..... 336/229; 336/20; 336/196

[58] Field of Search ..... 336/20, 225, 229, 336/196, 222; 441/7

[56] References Cited

U.S. PATENT DOCUMENTS 1,656,933 1/1928 Ahlstrand .
3,263,191 7/1966 Arvonio .
3,293,583 12/1966 Kronsbein .
4,058,742 11/1977 O'Brien .
4,177,468 12/1979 Seeley et al. .
4,283,794 8/1981 Underhill et al. .
4,475,109 10/1984 Dumas et al. .
4,482,333 11/1984 Geri et al. .

*Primary Examiner*—Michael L. Gellner
*Assistant Examiner*—D. Chapik
*Attorney, Agent, or Firm*—Harvey Fendelman; Thomas Glenn Keough

[57] ABSTRACT

An inflatable high Q toroidal inductor is fabricated from an inflatable toroidal-shaped shell made from a flexible material provided with a fitting adapted to receive and vent pressurized gas. A pair of flexible strips are disposed on opposite sides of the inflatable toroidal-shaped shell to hold litz windings in a predetermined toroidal configuration to thereby provide a suitable inductor of high Q and low loss. The inductor may be compactly carried to a remote instrumentation site, inflated and used and then deflated, folded and taken to the next site for reuse.

11 Claims, 2 Drawing Sheets

INFLATABLE HI Q TOROIDAL INDUCTOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

A number of very low frequency (VLF) and low frequency (LF) transmitting antennas remain in use for a variety of communications purposes. By their nature, many of these transmitters are of extremely high power, some on the order of 1.2 megawatts, and a few have been used for a considerable time; one particular site was constructed in 1915. The combined factors of high output power and age have been found to be major contributors to possible changes in the insulators that are associated with these installations. As a consequence, these systems must be evaluated from time to time to ascertain if there has been any degradation of the insulators or other components.

One practical method for performing such an evaluation is to measure the antenna resistance well below the actual and anticipated operating frequencies. Typically, these measurements are made at a few kHz or so. In order to make such measurements, however, the antenna needs to be tuned to resonance at these low frequencies. Usually there is not enough tuning inductance at the transmitter sites to tune the antennas to the frequencies required for these measurements. For example, the VLF antennas are designed to operate down to about 15 kHz and the LF antennas to about 50 kHz. Therefore, large amounts of inductance must be added to tune the antenna to these required frequencies, and in order to make accurate resistance measurements, the added inductance must be Hi Q.

An appropriate inductance might take the form of a variety of coil configurations, for example toroidal inductors are coils of wire wound on a toroid. They have a characteristic very Hi Q (low loss) because the magnetic field is primarily confined to the inside of the toroid. A solenoidal coil is not as attractive a choice since, by comparison, a toroidal coil has less loss than a solenoidal coil. This is because solenoidal coils have large exterior magnetic fields, particularly off the end of the coil, and, hence, induce currents in surrounding objects, which result in losses. A discussion of the designs of both these types of inductors can be found in F. E. Terman's *Radio Engineer's Handbook*, McGraw Hill, 1943, p. 58.

The measurements need to ne made with significant power (several hundred watts minimum) which means that the voltage across and current through the inductor are significant. Therefore, a suitable inductance, be it in a toroidal form or other design, is a large and cumbersome component if it is to provide a sufficient inductance and high Q for the accurate resistance measurements. Since the sites where these measurements must be made are usually at far-flung, remote locations in sometimes relatively inaccessible terrain, it is difficult and expensive to transport the sizeable, rigid high-value inductors that are required for accurate measurements so that a compromise is made.

In accordance with this inventive concept a need has been discovered in the state of the art for a high value inductor that is readily transportable to a remote site which has an inflatable toroidal form for coiled toroidal inductors.

SUMMARY OF THE INVENTION

The present invention is directed to providing a high-Q factor inductor that is light and portable. A flexible toroidal-shaped shell is coupled to a source of pressurized gas which inflates the flexible shell to assume a toroidal shape. One or two flexible annular bands are secured at intervals to the toroidal shell to hold at least one flexible inductor in a toroidal-shaped winding configuration on the toroidal-shaped shell. Using flexible litz wire windings that are held in place by the flexible bands on the inside and outside of the inflated toroidal-shaped shell provides a very low loss inductor with a very high Q.

An object of the invention is to provide a toroidal inductor mounted on an inflatable toroid shell.

Another object is to provide a toroidal inductor on an inflatable toroidal shell having a significant inductance with a very high Q.

Another object of the invention is to provide a lightweight and portable inductor with high Q which is ideal for field use.

Still another object is to provide an inflatable toroidal-shaped inductor with a high Q which can be inflated to enable its being packed away in a relatively small space for transportation.

Yet another object is to provide a high quality factor (high Q) inductor that is light and portable, suitable to be used to measure a dielectric loss from VLF and LF antennas.

Another object is to provide a portable toroidal inductor suitable for measuring the dielectrical loss from insulators in VLF and LF antennas in remote locations.

Yet another object is to provide a large, low loss toroidal coil on an inflatable form in order to be able to reduce the size for transportation.

Another object to provide a high Q inductor capable of withstanding the voltage and current due to a few hundred watts necessary to make antenna measurements at frequencies much below antenna self resonance.

These and other objects of the invention will become more readily apparent from the ensuing specification and claims when taken in conjunction with the appended drawings.

DESCRIPTION OF THE PREFERRED EMBODIMENT

A toroidal coil fabricated in accordance with this invention is useful for many radio frequency applications including LF and VLF due to its low loss and wideband characteristics. A unique way to make a large low loss toroidal coil on an inflatable form is provided in order to be able to reduce the size and weight of the toroidal coil for transport. A toroidal coil fabricated in accordance with this invention is transported deflated and inflated for use, and later, deflated and stored for future use. In order to get the low losses required for the VLF and LF applications of this coil, it is made large and can be fabricated from litz wire.

Figure 1:
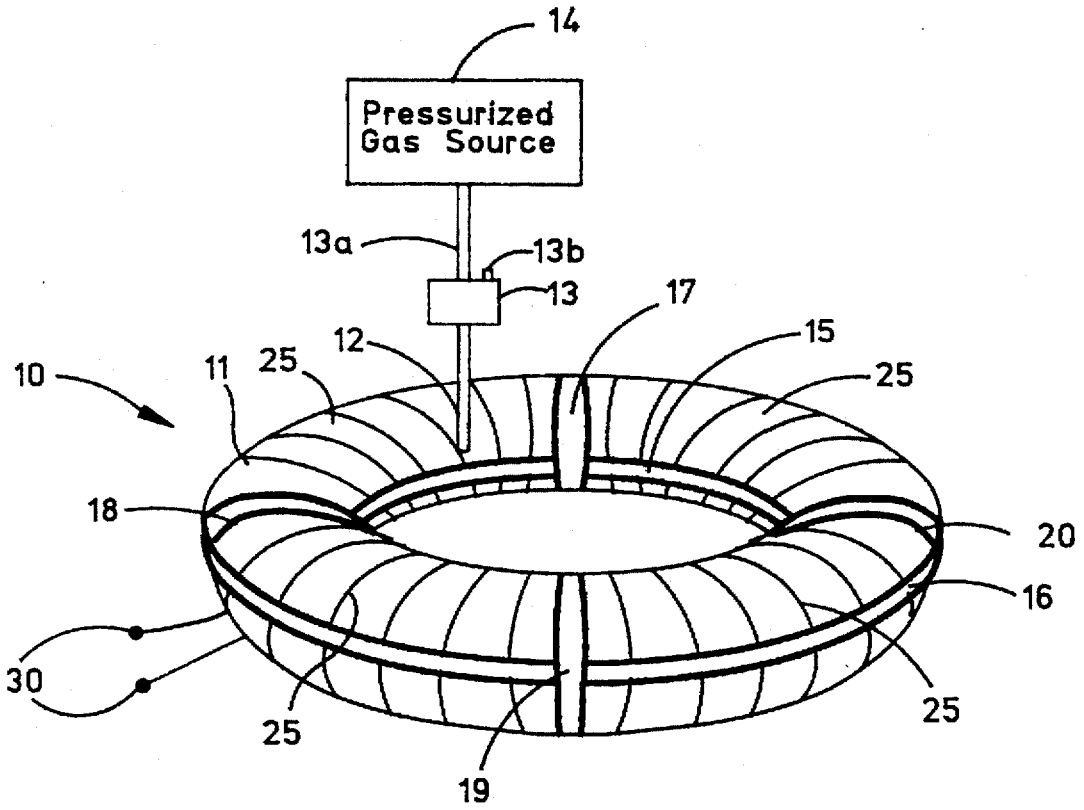
FIG. 1 is an isometric depiction of an inflatable toroidal-shaped coil with high Q in accordance with this invention.

Referring to FIG. 1 of the drawings, an inflatable toroidal coil 10 fabricated in accordance with this invention includes a flexible donut-shaped or toroid-shaped shell 11. The toroid-shaped shell can be fashioned out of any one of a variety of plastic or plastic-like flexible materials. An appropriate fitting 12 is provided with a suitable valve 13 to permit a selective inflating via a pressurized gas source 14 and venting of the pressurized gas from the interior of the inflatable toroid.

At first glance, the shape of the inflatable toroid shell suggests the use of the well known and conventional inflatable auto tire innertube. However, innertubes are not desirable for the purpose of this inventive concept as the rubber material is lossy and will reduce the Q of any coil wound on it. Consequentially, inflatable toroid shell 11 is preferably made out of a very low loss plastic material, such as that used for some commercial plastic swimming tubes.

An inner flexible band 15 and an outer flexible band 16 are provided to give an increased degree of structural integrity to the inflatable toroid shell. The inner and outer flexible bands are respectively held in place on an inner surface and an outer surface of the inflatable toroid shell by a number of resilient, expandable bands 17, 18, 19, 20. The expandable bands may be glued or bonded onto the inflatable toroid and serve to hold the inner and outer flexible bands in place.

The inner and outer flexible bands are fashioned to hold a toroidal coil 25 in place on inflatable toroid 11. In addition to the resilient or expandable bands 17, 18, 19, 20, the inner layer of both inner and outer flexible bands 15 and 16 may be suitable attached to the inflatable toroid shell in several places.

Figure 2A:
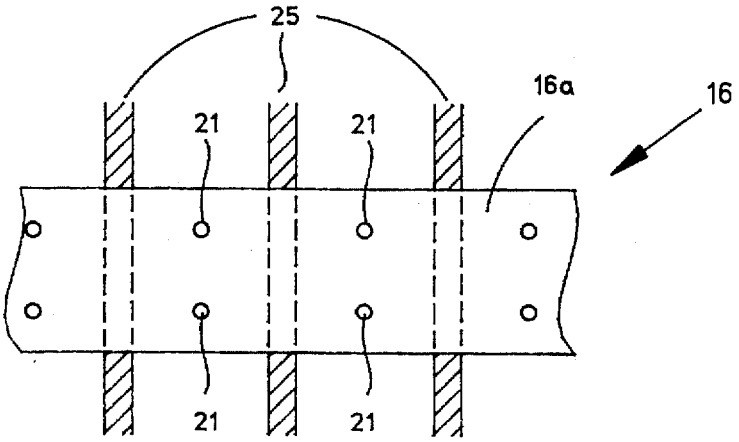
FIG. 2A depicts a top view of details of the flexible bands which are attached between windings by pop rivets, adhesive or other suitable means.
Figure 2C:
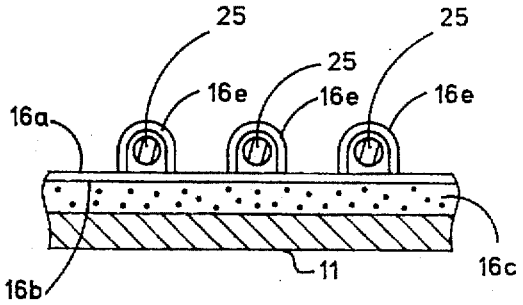
FIG. 2C shows a modification in which a series of loops secured on a single strip is bonded onto an inflatable shell to locate a conductor winding in a predetermined position.
Figure 2B:
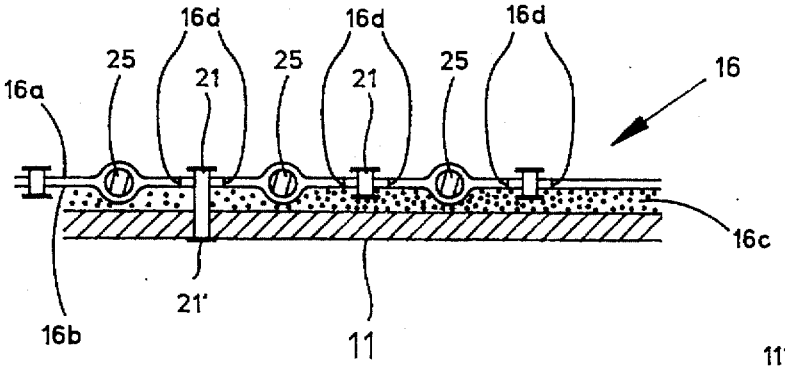
FIG. 2B depicts a side view of details of the flexible bands holding the litz conductors in accordance with this invention.

Looking to FIGS. 2A and 2B of the drawings, outer band 16 is depicted, it being understood that inner band 15 is substantially the same. The flexible bands position and hold at least one helical conductor winding 25 on the outside of inflatable toroid shell.

The conductor winding passes between inner and outer layers **16*a* and 16*b* of flexible band 16. Pop rivets 21 or, for that matter, a suitable adhesive 16*d* or other appropriate fastener is disposed at the location shown by the pop rivets, to locate and position the windings in a substantially equidistant relationship from one another to form a helical toroidal coil on inflatable toroid shell 11. A single or multiple helical toroidal winding having a pair of terminals 30 for suitable attachment to other components can be formed on the outer surface of the inflatable toroid shell. The pop rivets may be tailored to extend through the wall of the inflatable toroid shell as shown by rivet 21' or a suitable adhesive 16*c* can be provided to connect an inner, adjacent layer of the inner and outer flexible band to the surface of the inflatable toroid shell. The rivets can only be used to hold the two layers 16*a* and 16*b* together with a suitable adhesive 16*c* being used to hold the flexible band on inflatable toroid shell 11 to maintain the windings 25** at a predetermined disposition. If the rivets or other wall-penetrating means of attachment to the inflatable toroid are selected, a suitable sealant or other appropriate modification must be included to assure the pressure tight integrity of the inflatable toroid.

The embodiment of FIG. 2C shows a plurality of appropriately spaced loops **16*e* sewn into layer 16*a* to maintain conductors 25 at a predetermined spatial distribution. The loops and layer are held on an inflatable shell 11 by adhesive 16*c*** or the rivets, mentioned before, or any one of a number of suitable securing means, provided the necessary precautions of maintaining a sealed interconnection are not forgotten.

Since a high Q coil is envisioned for the use of the inflatable toroidal coil fabricated in accordance with this invention, litz wire may be used for the conductor windings since litz wire has a very low loss which can increase the Q of the coil to about 1000 or more. Another attribute of the litz wire which is advantageously realized in this invention is its flexibility. When the inflatable toroid is deflated, the entire structure, including the windings, will flex and fold to enable storage in a relatively small space. The collapsible, lightweight and transportable capabilities of inflatable toroid coil 10 also are due to the fact that the windings of the litz wire are held in place by flexible bands on the inside and outside of the inflatable toroid surface. The relatively small areas of attachment by either rivets 21 or a suitable adhesive where the rivets would otherwise be, further contribute to the significant features of the inflatable toroid coil that is fabricated in accordance with this inventive concept.

The advantages of the aforedescribed inflatable toroidal coil 10 make it light and portable and therefore ideal for field use. A single operator can handle it, use it and pack it away in a relatively small space for transportation. Since the coil is in the toroidal form, the Q of the coil is very high, in the neighborhood of 500 to 1000, a highly desirable feature for VLF and LF applications. Its fabrication costs are low.

At the work site, valve 13 is suitably connected to a pressurized gas source 14 and the inflatable toroid shell 11 is inflated. Each litz wire coil of toroid coil 25 is adjusted throughout its length to have a desired spacing, probably uniform, to provide a significant inductance with the characteristic of having a very high Q (low loss). The inflatable toroid coil 25 is coupled to equipments through terminals 30. Upon completion of use, valve 13 is suitable actuated to deflate inflatable toroid shell 11 and inflatable toroid coil 10 is folded up for transportation or storage and future use.

Figure 3:
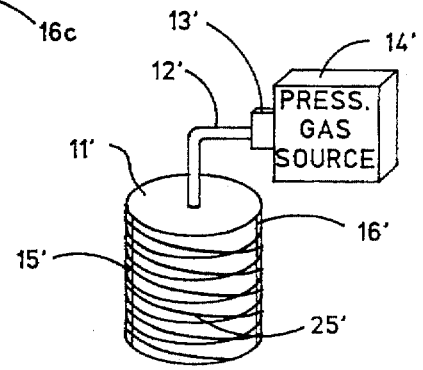
FIG. 3 shows a variation of this invention in which an inflatable cylindrical-shaped shell coupled to a source of pressurized gas functions as a support for solenoidal conductor windings held in place.

In accordance with this inventive concept, besides using a toroidal-shaped flexible shell, any other inflatable form could be used to construct a coil, for example a solenoidal coil could be used on an inflatable cylinder if desired, see FIG. 3. A solenoid-shaped shell 11' has a fitting 12' and valve 13' linking it to a source of pressurized gas 14'. A pair of flexible strips 15' and 16' hold windings 25' in a solenoid coil arrangement where this sort of a flexible inductor configuration has application.

Other alternative ways to attach the coil wires to the inflatable form are envisioned within the scope of this inventive concept. An adhesive could be used on the outer surface of the inflatable form to attach the individual wires. VELCRO strips also could be used if desired.

Obviously, many modifications and variations of the present invention are possible in the light of the above teachings. It is therefore to be understood that within the scope of the appended claims the invention may be practiced otherwise than specifically described.

We claim:

1. A portable inflatable inductor comprising:

an inflatable toroid shell fabricated from a flexible material having a fitting coupled to a pressurized gas source for inflating and deflating said shell;

a conductor winding wrapped around said shell having a pair of terminals; and a holder disposed on said shell comprising at least one flexible strip attached to said shell and a plurality of spaced securing elements for holding said conductor winding thereon in a predetermined spaced relationship.

2. The portable inflatable inductor of claim 1 wherein said holder comprises an inner flexible strip and an outer flexible strip disposed adjacent an inner and an outer surface of said shell respectively.

3. An inflatable inductor according to claim 2 in which said inner flexible strip and said outer flexible strip each have an inner layer and an outer layer that are joined together and are connected to said shell.

4. An inflatable inductor according to claim 1 in which said conductor winding is a toroid fabricated from litz wire.

5. An inflatable inductor according to claim 2 in which said conductor winding is a toroid fabricated from litz wire.

6. An inflatable inductor according to claim 3 in which said conductor winding is a toroid fabricated from litz wire.

7. An inflatable inductor according to claim 4 in which said conductor winding has a Q of greater than about 500.

8. An inflatable inductor according to claim 5 in which said conductor winding has a Q of greater than about 500.

9. An inflatable inductor according to claim 6 in which said conductor winding has a Q of greater than about 500.

10. An inflatable inductor according to claim 1 in which said conductor winding has a Q of greater than about 500.

11. An inflatable inductor comprising an inductor mounted on an inflatable shell, wherein said inductor and said inflatable shell are toroid-shaped.

* * * * *